US005278381A

United States Patent [19]

Rilly

[11] Patent Number: 5,278,381

[45] Date of Patent: Jan. 11, 1994

[54] INDUCTIVE COOKING DEVICE

[75] Inventor: Gerard Rilly, Unterkirnach, Fed. Rep. of Germany

[73] Assignee: Thomson Electromenager S.A., Paris, France

[21] Appl. No.: 808,512

[22] Filed: Dec. 17, 1991

[30] Foreign Application Priority Data

Dec. 17, 1990 [DE] Fed. Rep. of Germany ..... 4040281

[51] Int. Cl.[5] ..... H05B 6/12

[52] U.S. Cl. ..... 219/624; 219/666; 156/81; 156/272.2

[58] Field of Search ..... 219/10.493, 10.491, 219/10.75, 10.77, 10.79, 10.53; 156/81, 272.2, 272.4, 275.7, 285, 308.2, 382

[56] References Cited

U.S. PATENT DOCUMENTS

| | | | |
|---|---|---|---|
| 3,742,179 | 6/1973 | Harnden | 219/10.77 |
| 3,761,668 | 9/1973 | Harnden et al. | 219/10.491 |
| 3,979,572 | 9/1976 | Ito et al. | 219/10.491 |
| 3,996,442 | 12/1976 | Moreland, II et al. | 219/10.79 |
| 4,348,571 | 9/1982 | Dills | 219/10.49 |
| 4,467,162 | 8/1984 | Kondo et al. | 219/10.49 R |
| 4,996,405 | 2/1991 | Poumey et al. | 219/10.493 |

FOREIGN PATENT DOCUMENTS

| | | |
|---|---|---|
| 0271250 | 6/1988 | European Pat. Off. . |
| 871486 | 8/1951 | Fed. Rep. of Germany . |
| 7333691 | 9/1973 | Fed. Rep. of Germany . |
| 2643449 | 3/1978 | Fed. Rep. of Germany . |
| 2754963 | 6/1979 | Fed. Rep. of Germany . |
| 3217850 | 11/1983 | Fed. Rep. of Germany . |
| 3723485 | 1/1989 | Fed. Rep. of Germany . |

OTHER PUBLICATIONS

8095 IEEE Transactions on Industry Applications, vol. IA-19 (1983) Jul.-Aug., No. 4, New York, USA T. Miyoshi et al.: "Reduction of Magnetic . . . ".

*Primary Examiner*—Bruce A. Reynolds
*Assistant Examiner*—Tu Hoang
*Attorney, Agent, or Firm*—Spencer, Frank & Schneider

[57] ABSTRACT

An inductive cooking device for reducing disturbance radiation has a shielding housing with an opening in the region of a cooking (hot) plate containing an induction coil. A further coil, the ends of which are connected by a capacitor, is provided in the region of the opening.

13 Claims, 1 Drawing Sheet

INDUCTIVE COOKING DEVICE

BACKGROUND OF THE INVENTION

1. Field of the Invention

The invention relates to an inductive cooking device, and in particular to reducing disturbance radiation in such a device.

2. Background Information

An inductive cooking device is known from DE-OS 37 23 485. Such an inductive cooking device contains a heating coil which is fed from a generator with an alternating current of approximately 5 to 30 at a frequency in the range of 20 to 30 kHz. The heating coil generates currents by induction in the sides of a pan placed above the cooking (hot) plate which heats the items to be cooked placed in the pan. Due to the relatively high power involved of 300 to 6000 W, such cooking devices produce magnetic leakage (stray) fields which can interfere with consumer electric devices such as radio receivers, located in the vicinity of the cooking area. Therefore, a way of minimizing such stray fields are required.

It is known to surround the entire cooking device with a protective screen (shielding). However, this screen must have an opening in the region of the cooking plate on which the pan is placed because otherwise the induction field cannot emerge and pass into the cooking pan. This unavoidable opening leads to stray fields being emitted, in particular on upper harmonic waves of the operating frequency.

SUMMARY OF THE INVENTION

It is therefore the object of the invention to create a defined suppression of certain disturbing frequencies in such a cooking device using passive means simple in construction.

This task is solved according to the invention by providing a resonant coil, the ends of which are connected together by a capacitance in the region of the opening.

The invention is based on the following finding. The resonant coil, in the most simple case a single arc-shaped conductor, forms an oscillating circuit together with the capacitor. The resonance (natural) frequency of the oscillating circuit can be selected by choosing an appropriate capacitor. The oscillating circuit forms, for the induction field, an absorption circuit for a frequency selectable by tuning and, therefore, causes a desired significant attenuation of the respective disturbance frequency. A particularly good effect is then achieved when all areas apart from the cooking plate itself are surrounded by a metal screen.

The solution according to the invention is of simple construction. In the most simple case it merely consists of an arc-shaped conductor in the form of a wire or flat metal strip and a commercially available capacitor. The energy loss of the shielding ring formed in this fashion is low because it is not a short-circuit winding and essentially, only idle power is consumed in the ring. A short-circuit ring would cause a considerable power loss through induced current. Apart from that, such a ring would not effect an attenuation of certain frequencies but, on the contrary, cause only an aperiodic attenuation, the effect of which would be too low to suppress the perturbing radiation.

BRIEF DESCRIPTION OF THE DRAWINGS

Embodiments of the invention are illustrated in the drawings. Therein is shown.

DETAILED DESCRIPTION OF THE PREFERRED EMBODIMENTS

Figure 1:
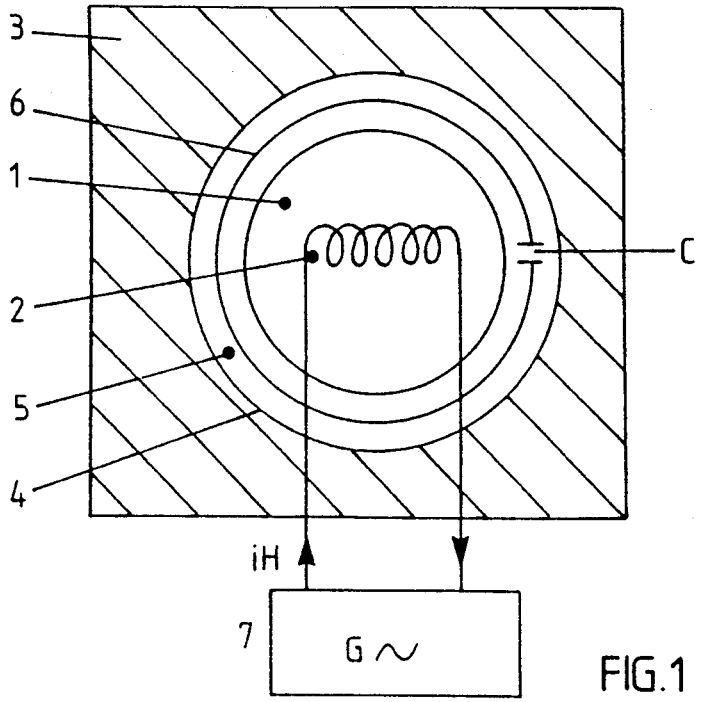
FIG. 1 is a schematic of a cooking device with the shielding ring according to the invention in simplified form.

FIG. 1 shows a cooking plate 1 in which a heating coil 2 is located. The cooking device is surrounded on all sides by a shielding housing 3 made of metal which only has a round opening 4 in the region of the cooking plate 1. The magnetic induction field generated by the winding 2 emerges through this opening and passes into a cooking pan for the purpose of heating. Due to the opening 4, a gap 5 is formed between the shielding housing 3 and the cooking plate 1. The ends of a conductor 6 are connected to each other via a commercially available capacitor C. The generator 7 supplies the heating coil 2 with a current iH of 5 to 30 A at frequency of about 30 kHz.

In this embodiment, only a coil, consisting of the arc-shaped bent conductor 6, is placed in the gap 5. The oscillating circuit formed by the conductor 6 and the capacitor C is tuned to frequencies to be suppressed in the stray field emanating from the cooking device. These are, in particular, upper harmonic waves of the operating frequency of the cooking device, or frequencies of radio transmitter signals being received in the vicinity of the cooking device and which can be disturbed by the cooking device. The capacitor C has, for example, a capacity in the order of magnitude of 1 $\mu$F (microfarad). The shielding housing 3 is preferably made of aluminum. For suppressing differing frequencies, several such screening rings each consisting of a conductor 6 and a capacitor C can be arranged adjacent or above each other. The shielding ring formed thus does not necessarily have to be located in a gap between the shielding housing 3 and the cooking plate 1. It can, if necessary, be situated in the region of the heating coil 2. The optimum position of the shielding ring is preferably determined empirically.

Figure 2:
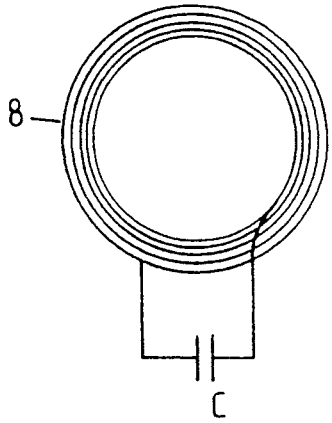
FIG. 2 is a schematic of a particular embodiment of the coil.
Figure 2:
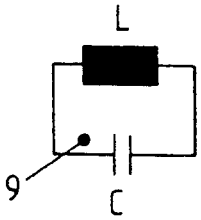

In FIG. 2 the coil is formed by a toroid coil 8 which has roughly the shape of the conductor 6 in FIG. 1. The two ends of the ring-shaped, wound-up wire forming the coil 8 are again connected to each other via the capacitor C. As shown on the right-hand side of FIG. 2, such an arrangement forms an absorption circuit 9 with an inductance L and a capacitor C.

Figure 3:
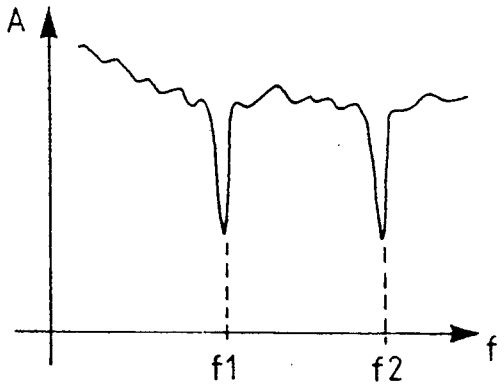
FIG. 3 is a graph showing in principle suppressed disturbance frequencies in the frequency spectrum.

FIG. 3 shows the frequency spectrum of a stray field measured in the vicinity of the cooking device. Using two screening rings constructed according to FIGS. 1 and 2, two attenuation points are formed at frequencies f1, f2. These attenuation points or traps have an attenuation of about 10 dB and a band width of 50 to 100 kHz. The frequencies f1, f2 preferably lie at the upper harmonic waves of the operating frequency, i.e. the frequency of the current iH, and/or at frequencies of radio transmitter signals being received in the vicinity.

Figure 4:
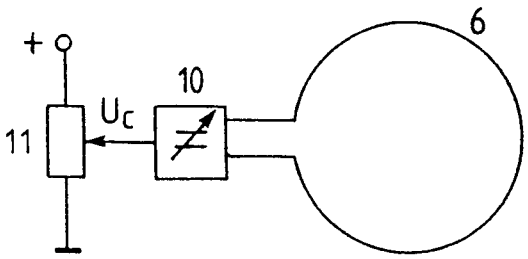
FIG. 4 is a schematic of a further development of the invention.

In FIG. 4 the capacitor C is formed by an electronic circuit 10, the output of which represents a capacitance C. The value of the capacitance C can be altered by a voltage Uc which is taken from a potentiometer 11. This solution has the advantage that a simple and very precise tuning of the absorption circuit formed for a certain frequency can be carried out. The voltage Uc can also be a regulating voltage derived from the amplitude of a measured interference component. By using a frequency-selective circuit (not shown) the amplitude of a certain interference component can be measured. The regulating voltage obtained from this circuit thereby alters the frequency of the absorption circuit in such a way that the amplitude of the interference component is only minimal. The use of more than one facility according to FIG. 4, therefore, means that several components of defined frequencies in the frequency spectrum of the cooking device can be selectively suppressed with sufficient amplitude.

I claim:

1. An inductive cooking device comprising:

a cooking plate with an induction heating coil;

a shielding housing having an opening in which the cooling plate having the induction heating coil is disposed; and a resonant circuit including a resonant coil connected in series with a capacitance, said resonant coil being disposed in an annular gap between an outer edge of said cooking plate and an inner edge of the opening and surrounding said cooking plate.

2. An inductive cooking device comprising:

a cooking plate with an induction heating coil;

a shielded housing having an opening in which the cooking plate with the induction heating coil is disposed; and a plurality of resonant coils, each tuned to a different frequency by a respective capacitance connected in series therewith, said resonant coils being disposed in the opening with said cooking plate.

3. A cooking device according to claim 1, wherein the resonant coil comprises one conductor bent into a ring shape.

4. A cooking device according to claim 3, wherein the resonant coil conductor is a flat metal strip.

5. A cooking device according to claim 1, wherein the resonant coil is formed as a toroid coil having a plurality of windings.

6. A cooking device according to claim 1, wherein the resonant coil is tuned to an upper harmonic of an operating frequency of the cooking device.

7. A cooking device according to claim 1, wherein the resonant coil is tuned to a frequency of a radio transmitter signal which is received in an area near the cooking device.

8. A cooking device according to claim 1, wherein the resonant coil is formed as a plurality of coils, each tuned to a different frequency by a respective capacitance connected to respective ends thereof.

9. A cooking device according to claim 1, wherein the capacitance comprises an electronic circuit which is adjustable by application of a voltage for tuning the resonant coil and electronic circuit to a desired frequency.

10. A cooking device according to claim 9, wherein the electronic circuit is regulated by a regulating voltage derived from an interference component amplitude of a magnetic stray field of the cooking device.

11. A cooking device according to claim 10, wherein the regulating voltage is derived by a frequency-selective circuit operatively coupled to the electronic circuit.

12. In an inductive cooking device having a shielded housing in which a current generator is disposed, a cooking plate disposed in an opening of the housing, and an inductive heating coil disposed in the cooking plate and connected to the current generator, an interference suppression arrangement comprising:

a resonant circuit including at least one series connection of a resonant coil and a capacitance;

wherein said resonant coil is disposed in an annular gap between an outer edge of the cooking plate and an edge of the opening in the housing and extends around the inductive heating coil of the cooking plate.

13. The interference suppression arrangement according to claim 12, wherein said at least one series connection of a resonant coil and capacitance comprises a plurality of series connections each tuned to a different frequency, and wherein each coil of said plurality of series connections is disposed in the annular gap.

* * * * *